US006808023B2

(12) United States Patent
Smith et al.

(10) Patent No.: US 6,808,023 B2
(45) Date of Patent: Oct. 26, 2004

(54) DISCONNECT CHECK VALVE MECHANISM FOR COILED TUBING

(75) Inventors: Peter V. Smith, Sugar Land, TX (US); Lawrence J. Leising, Missouri City, TX (US); Robert M. Ramsey, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/281,621

(22) Filed: Oct. 28, 2002

(65) Prior Publication Data

US 2004/0079531 A1 Apr. 29, 2004

(51) Int. Cl.[7] ..... E21B 34/12

(52) U.S. Cl. ..... 166/386; 166/242.7; 166/325; 166/332.8; 166/334.1; 166/377

(58) Field of Search ..... 166/323, 325, 166/322, 317, 318, 332.8, 334.1, 377, 242.6, 242.7, 386

(56) References Cited

U.S. PATENT DOCUMENTS

| | | | | | |
|---|---|---|---|---|---|
| 2,354,310 | A | * | 7/1944 | Goodwin | 251/348 |
| 3,148,731 | A | * | 9/1964 | Holden | 166/141 |
| 3,997,006 | A | * | 12/1976 | Wetzel | 166/377 |
| 4,378,847 | A | * | 4/1983 | Patel et al. | 166/317 |
| 6,250,393 | B1 | * | 6/2001 | Mackenzie et al. | 166/380 |
| 6,269,883 | B1 | * | 8/2001 | Gissler et al. | 166/340 |
| 6,408,946 | B1 | * | 6/2002 | Marshall et al. | 166/317 |
| 6,446,727 | B1 | | 9/2002 | Zemlak et al. | |
| 6,475,520 | B1 | * | 11/2002 | Liu et al. | 424/464 |

OTHER PUBLICATIONS

"In–Line Centralizer", Petro Tech Tools, Inc., 1999, 2 pages.
"Bypass Double Flapper Check Valve", Petro–Tech Tools, Inc., 1999, 3 pages.
"Coiled Tubing Twin Flapper Check Valve With Lock Out Sleeve", Pressure Control Engineering, 1 page.

* cited by examiner

*Primary Examiner*—Hoang Dang
(74) *Attorney, Agent, or Firm*—Wayne I. Kanak; Robin Nava; Brigitte Echols

(57) ABSTRACT

A tubing conveyed disconnect check valve mechanism having releasable connection with a payload tool and being selectively actuated downhole for disconnecting from the payload tool for retrieval by the tubing string, with the check valve enabled for direct circulating flow and preventing the inflow of wellbore fluids, while permitting the payload tool to remain in the well. A housing is connected to a tubing string, such as coiled tubing, and incorporates at least one check valve and defines a first disconnect connector which is releasably connected with a second disconnect connector of the payload tool housing. A check valve positioning mandrel is releasably retained at a check valve disabling position within the housing for establishing a reverse circulating flow path through the check valve and is released from the housing and moved to a check valve enabling position, closing the reverse circulating flow path and permitting direct circulating flow only.

16 Claims, 3 Drawing Sheets

DISCONNECT CHECK VALVE MECHANISM FOR COILED TUBING

BACKGROUND OF THE INVENTION

1. Field of the Invention

The present invention relates generally to a disconnect check valve mechanism that is applicable for releasable connection with a wide variety of payloads such as direct circulating flow valves, reverse circulating flow valves, formation fracturing tools and the like. More specifically, the present invention concerns a disconnect check valve mechanism that is connected to a payload, run into a well, and operated in a reverse circulating flow condition until its disconnect is actuated, leaving the payload within the well and permitting retrieval of the disconnect check valve mechanism with its check valve or valves enabled, thus permitting only direct circulating flow and preventing the inflow of wellbore fluids into the tubing string.

2. Description of Related Art

It is a safety standard in coiled tubing operations, to have a check valve assembly with a minimum of two pressure barriers in the tool string. In many coiled tubing operations, such as fracturing and well cleanout operations, it is desirable to reverse circulate through the coiled tubing. Reverse circulating (flowing upwardly within the passage of the coiled tubing instead of downwardly) is not possible when a conventional direct circulating dual check valve mechanism is employed.

BRIEF SUMMARY OF THE INVENTION

It is a principal feature of the present invention to provide a novel tubing supported disconnect check valve mechanism or tool that functions as a passive selectively operated disconnect apparatus to which a variety of well servicing tools or payloads may be connected for use in a variety of well servicing applications.

It is also a feature of the present invention to provide a novel tubing supported disconnect check valve mechanism that can be selectively disconnected from the payload to which it is connected, and retrieved from the well with its check valve or valves in the retrieved portion thereof enabled, thus permitting direct circulating flow only while preventing the inflow of wellbore fluids into the tubing.

It is another feature of the present invention to provide a novel tubing supported disconnect check valve mechanism that accommodates industry safety standards when the tubing being utilized within the well is coiled tubing, so that downhole check valve barriers are provided during retrieval to prevent the inflow of wellbore fluids into the tubing.

Briefly, the various objects and features of the present invention are realized by providing a tubing supported disconnect check valve mechanism that is run into a wellbore connected with a payload in the form of a well servicing tool (which may be as simple as a ported bullnose), and with its check valve disabled by a mandrel within the disconnect check valve mechanism which is normally maintained at a check valve disabling position and is selectively released from its retained position and moved to a check valve enabling position. The disconnect check valve mechanism is normally passive within the tool until such time as disconnect and retrieval becomes desirable or necessary. For retrieval of the disconnect check valve mechanism, the internal mandrel is actuated to its valve enabling position, thus enabling the check valve or valves to prevent reverse circulating flow and the inflow of wellbore fluids while permitting direct circulating flow. The internal mandrel can be actuated to its valve enabling position by a drop ball and tubing pressure, by tension, by pressure differential, or by any other suitable means, and is retrieved along with the disconnect check valve mechanism after separation of the disconnect check valve mechanism from the payload tool. The housing of the payload or well servicing tool defines an internal pulling profile, thus permitting its retrieval by a fishing tool, spear, overshot, or any other type of retrieving tool.

After a well servicing operation has been completed, assuming the payload well servicing tool is to be retrieved from the well, as is typically the case, a tension force is applied to the housing of the disconnect check valve mechanism via the tubing string, thus moving the disconnect check valve mechanism and its connected payload upwardly within the well to the surface. The disconnect check valve mechanism will have remained passive during tool running, servicing operations, and during retrieval. In the event the payload well servicing tool should become stuck within the well, or if another condition should occur that makes it desirable to disconnect the disconnect check valve mechanism from the well servicing tool, the disconnect mechanism can be actuated to disconnect from the payload and to enable the check valve or valves for direct circulating flow only and prevention of the inflow of wellbore fluids. When the disconnect check valve mechanism is designed for drop ball and tubing pressure actuation, a closure ball is dropped or pumped through the tubing string to the disconnect check valve mechanism and blocks the flow passage of the internal tubular member or mandrel and, with the mandrel, defines a pressure responsive surface area or piston area. Disconnect actuation pressure is applied via the tubing string to act on the piston area and develop sufficient force to shear retainer pins or otherwise release the inner tubular member or mandrel from its check valve disabling position and shift the mandrel to its check valve enabling position. The inner tubular member or mandrel will then remain at this check valve enabling position within the tubular housing, thus causing the check valve mechanism to remain in its direct circulating flow mode. The mandrel moves down when the closure ball is dropped and the tubing pressured-up, but then comes out of the well with the check valves. This leaves the bore of the payload well servicing tool open and free to receive internal fishing tools after disconnecting.

BRIEF DESCRIPTION OF THE DRAWINGS

So that the manner in which the above recited features, advantages, and objects of the present invention are attained can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a longitudinal sectional illustration showing a well completed to a production formation and showing coiled tubing handling apparatus at the surface with coiled tubing being connected to a disconnect check valve mechanism having a payload connected thereto;

FIG. 2A is a longitudinal sectional view of an upper section of a disconnect check valve mechanism embodying the principles of the present-invention shown in coupled relation with a payload;

FIG. 2B is a longitudinal sectional view of a lower section of the disconnect check valve mechanism of FIGS. 1 and 2A showing the collet connector of the disconnect mechanism in its connected condition;

FIG. 3A is a longitudinal sectional view of the upper section of the disconnect check valve mechanism of FIGS. 1 and 2A coupled with a payload and showing a drop ball seated at the upper end of the valve disabling sleeve of the movable tubular internal mandrel with the sleeve being at its lowermost or valve enabling position within the tubular housing;

FIG. 3B is a longitudinal sectional view of the lower section of the disconnect check valve mechanism of FIGS. 1, 2A, and 3A showing the valve disabling sleeve in the direct circulating flow position with the disconnect mechanism connected to the payload;

Figure 1:
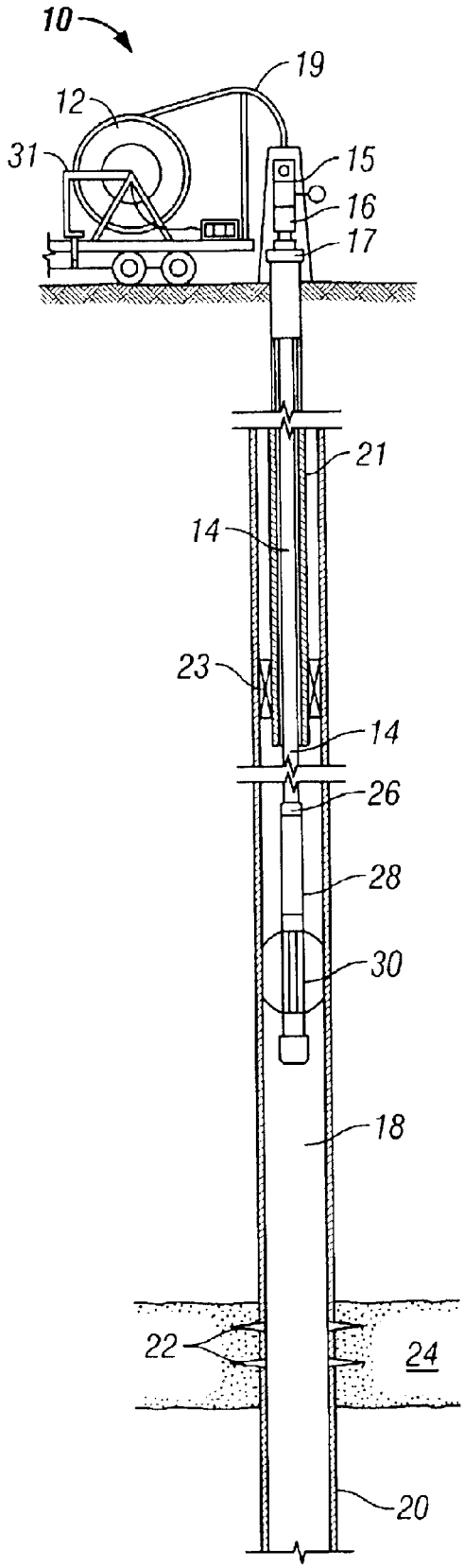
Figure 2A:
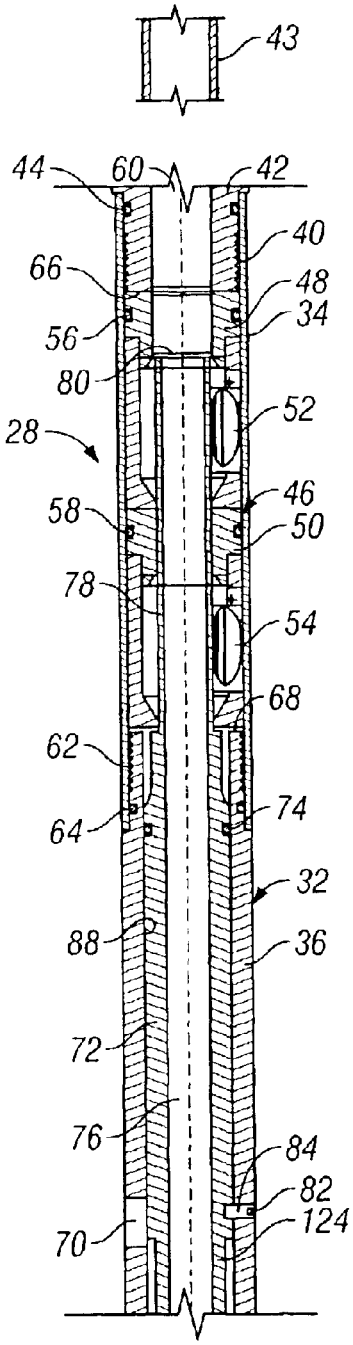
Figure 3A:
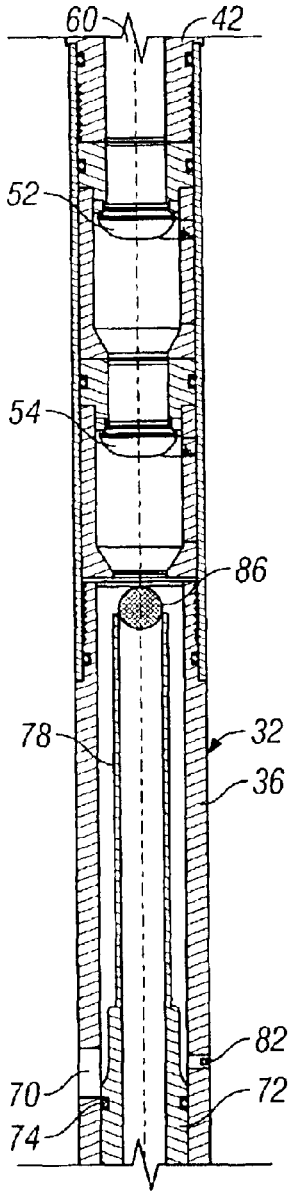
Figure 4A:
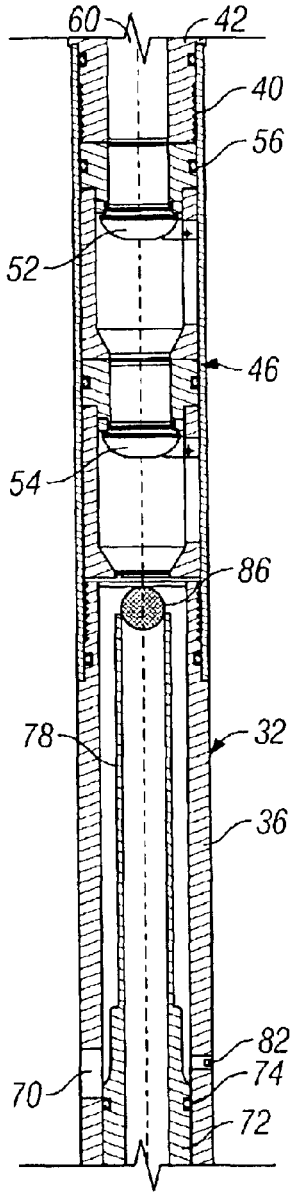
Figure 4B:
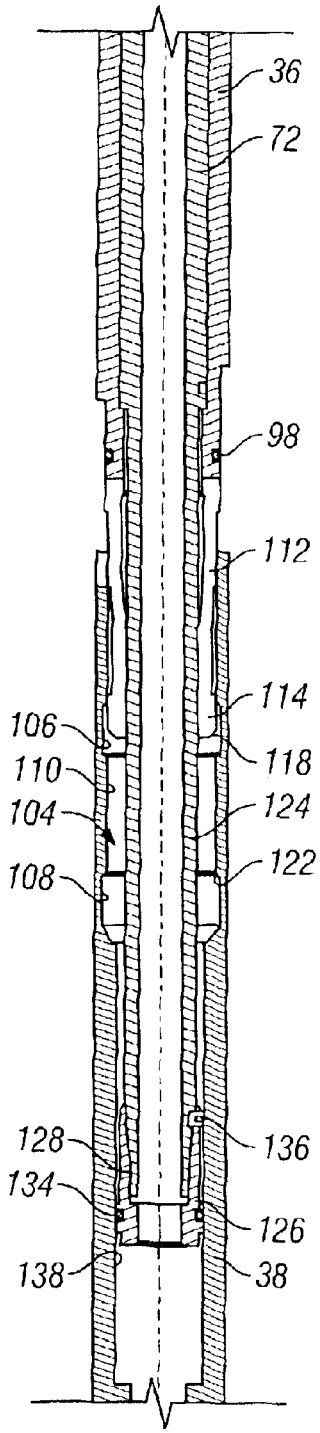

FIG. 4A is a longitudinal sectional view of the upper section of the disconnect check valve mechanism of FIGS. 1, 2A, and 3A showing the check valve mechanism in its direct circulating flow mode as in FIG. 3A; and FIG. 4B is a longitudinal sectional view of the lower section of the disconnect check valve mechanism of FIGS. 1, 2A, 3A, and 4A showing the disconnect check valve mechanism having been released by internal mandrel movement and tension force for retrieval from the well, with the payload tool remaining in the well.

DETAILED DESCRIPTION OF THE INVENTION

Referring now to the drawings and first to FIG. 1, a trailer or truck mounted mobile coiled tubing unit is shown generally at 10 and incorporates a tubing storage reel 12 from which coiled tubing 14 is run by an injector 15 through a blowout preventer 16 and a wellhead 17 into a well 18. The coiled tubing from the reel 12 passes along a guide 19 as it is moved into the well 18 by the injector 15. A length of production tubing 21 is supported by a hanger within the wellhead 17, with its lower end being sealed to the well casing 20 by a packer 23. The casing 20 is perforated at 22 to permit communication of the well with a production formation 24, from which petroleum products such as crude oil and natural gas are produced. The coiled tubing string 14 extends through the production tubing 21 to a desired depth within the well, typically a location above the casing perforations 22 as shown. A connector 26 is provided at the lower end of the coiled tubing, for support of a disconnect check valve mechanism, shown generally at 28, which embodies the principles of the present invention and which provides for releasable connection with a payload or well servicing tool 30 of any suitable character.

For injection of fluid through the coiled tubing and disconnect check valve mechanism into the well, a conduit 31 is connected to the centermost coil of the coiled tubing on the storage reel 12 and permits fluid from a supply tank (not shown) to be pumped through the coiled tubing. Although a casing is shown within the well, it is not intended to limit the present invention for use in wells having casings, it being intended that the present invention be applicable to open bore applications as well.

As mentioned above, it is desirable to provide a disconnect check valve mechanism that is designed for compliance with industry standards for coiled tubing applications in wells and to permit the connection of a well servicing tool, or payload thereto. The disconnect feature permits the disconnect check valve mechanism to be separated from the payload in the downhole environment and retrieved from the well with its check valve or valves enabled for flow responsive closure, thus permitting the payload to remain downhole. During retrieval of the disconnect check valve mechanism from the well, after disconnection has occurred, the check valve or valves will function to prevent reverse circulating flow and permit direct circulating flow, while preventing the inflow of wellbore fluids. It is to be borne in mind that the disconnect check valve mechanism has application in combination with a number of different types of payload tools for conducting well servicing operations. The disconnect check valve mechanism is particularly useful for releasable connection with a tool that can be run into a well in a reverse circulating flow mode to promote well clean-out using reverse circulating flow, with fluid being injected into the annulus of the well and caused to flow at relatively high velocity through the check valve mechanism and the tubing string to the surface, transporting sand and other constituents to the surface along with the fluid.

Figure 2B:
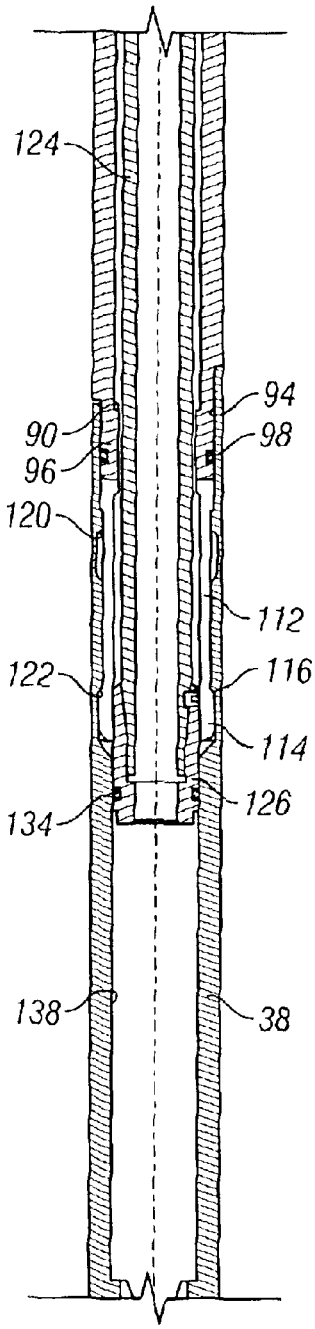

Referring now to FIGS. 2A and 2B, a disconnect check valve mechanism representing the preferred embodiment of the present invention, shown at 28 in FIG. 1, effectively accomplishes the aforementioned features. The disconnect check valve mechanism 28, comprises a tubular housing shown generally at 32 which is defined by a valve housing section 34 and an upper housing section 36 having a disconnect mechanism for connection of the disconnect check valve mechanism with, and for separation from, a payload, which is typically a well servicing tool. The upper end of the valve housing section 34 of the tubular housing 32 establishes a threaded connection 40 with a tubing connector 42, such as a tubing connector at the lower end of a tubing string 43 and is sealed to the tubing connector 42 by an O-ring seal 44.

Within the valve housing section 34 is maintained a check valve assembly shown generally at 46 which may be in the form of a dual check valve assembly having upper and lower valve bodies 48 and 50 providing operative support for upper and lower pivotal flapper type check valves 52 and 54. Though dual flapper type check valves are shown, a single check valve may be employed as well. It should also be borne in mind that the check valves may take the form of poppet type check valves, ball type check valves, or any other suitable type of check valves without departing from the spirit and scope of the present invention. The valve bodies 48 and 50 of the check valve assembly are sealed with respect to the inner surface of the valve housing section 34 by O-ring seals 56 and 58. The check valves 52 and 54 are each capable of opening responsive to downward, i.e., direct circulating flow of fluid from the tubing string through a central flow passage 60 of the connector 42, such as during injection of treating or fracturing fluid into the well. The check valves 52 and 54, when enabled for direct circulating flow, are moved to the closed positions thereof, such as shown in FIG. 3A, responsive to upward or reverse circulating flow of fluid from the well or from the annulus between the tool and the well casing or wellbore.

The upper housing section 36 of the tubular housing 32 is connected with the lower end of the valve housing by a threaded connection 62, with an O-ring seal 64 maintaining a sealed condition between the valve housing section 34 and the upper housing section 36. The position of the check valve assembly within the valve housing is maintained by a lower annular shoulder 66 of the connector 42 and by an annular shoulder 68 that is defined by the upper end of the upper housing section 36. The upper housing section 36 further defines a pressure relief port 70, the function of which is described in detail below.

In FIGS. 2A and 2B an inner tubular member or mandrel 72 is shown which is normally immovably secured within the tubular housing 32, except when a disconnect procedure is desired, and is then released from the tubular housing 32 and moved linearly to close the reverse circulating flow path and to position the check valve mechanism for direct circulating flow only. The inner tubular member or mandrel 72 is sealed with respect to the upper housing section 36 by an O-ring seal 74 or any other suitable annular sealing member. The inner tubular member 72 defines a central flow passage 76 through which fluid flows as it is injected into the well during direct circulating flow or when reverse circulating flow is occurring. A tubular valve disabling sleeve 78 extends upwardly from the inner tubular member 72 and, as shown in FIG. 2A, is positioned within the flow passage of the check valve assembly 46 for disabling the check valves 52 and 54 by maintaining the check valves in their fully open positions and preventing their pressure responsive closure. The valve disabling sleeve 78 defines an annular ball seat 80 at its upper end, which is best shown in FIG. 2A. The disconnect check valve mechanism 28 and its payload tool 30 is typically run into a well with the inner tubular member 72 retained in the valve disabling position shown in FIGS. 2A and 2B, thus enabling both direct and reverse circulating flow. One or more shear pins 82 are threaded through the upper housing section 36 with the inner ends of the shear pins 82 being received within shear pin receptacles 84 that are defined in the outer peripheral surface portion of the inner tubular member 72. The shear pin or pins 82 will be sheared when a downward force of predetermined magnitude is applied to the inner tubular member 72, thereby releasing the inner tubular member from its retained condition and permitting its downward movement within the tubular housing 32 to the check valve enabled position shown in FIGS. 3A and 4A. To accomplish shearing of the shear pins 82 and release of the inner tubular member 72 from the upper housing section 36, a closure member 86, such as a drop ball, or closure element of any other acceptable type, is dropped or pumped through the tubing string 43 and through the flow passage 60 and becomes seated on the annular ball seat 80. The drop ball type closure member 86 closes the flow passage of the inner tubular member 72 and defines a pressure responsive surface area or piston area having a piston dimension or area that is defined by circular contact of the annular seal element 74 with the inner cylindrical surface 88 of the upper housing section 36. Fluid pressure injected through the tubing string 43 into the tubular housing 32 acts on the piston area and establishes a pressure differential which develops a pressure responsive force acting downwardly on the inner tubular member or mandrel 72. When this (pressure times area) downward force exceeds the predetermined force required to shear the shear pins 82, the shear pins 82 will be sheared and the inner tubular member 72 will be released from its retained check valve disabling position. The downward pressure responsive force acting on the inner tubular member 72 will then move the inner tubular member or mandrel 72 downwardly until the annular seal member 74 moves across the pressure relief port 70, allowing the injected pressure to vent to the annulus of the wellbore or casing surrounding the tool. Relief or venting of the injected pressure in this manner dissipates the pressure responsive downward force acting on the inner tubular member 72 and minimizes the potential for slamming of the inner tubular member 72 within the tubular housing 32. Maximum downward travel of the inner tubular member 72 is limited by an upwardly facing annular stop shoulder 90, which is engaged by a downwardly facing annular shoulder 92 of the inner tubular member 72. Pressure responsive downward movement of the inner tubular member 72 in this manner causes the tubular valve disabling sleeve 78 to be withdrawn from the FIG. 2A position within the check valve assembly to a position clear of the check valves 52 and 54 and thus enables the check valves for reverse circulating flow responsive closing movement. This mandrel releasing and shifting activity will typically be done when it is desired to release the disconnect check valve mechanism from the payload. This feature permits the disconnect check valve mechanism to be retrieved in its direct circulating flow mode, thus providing one or more check valve barriers as is currently required by industry standards for coiled tubing applications in wells. As soon as the check valves have been opened by pressure responsive movement of the inner tubular member 72 to its lowermost position within the upper housing section 36, thus positioning the check valve mechanism for its direct circulating flow mode, the direct circulating flow mode can be confirmed at the surface by a reduction in pressure in the tubing string.

Figure 3B:
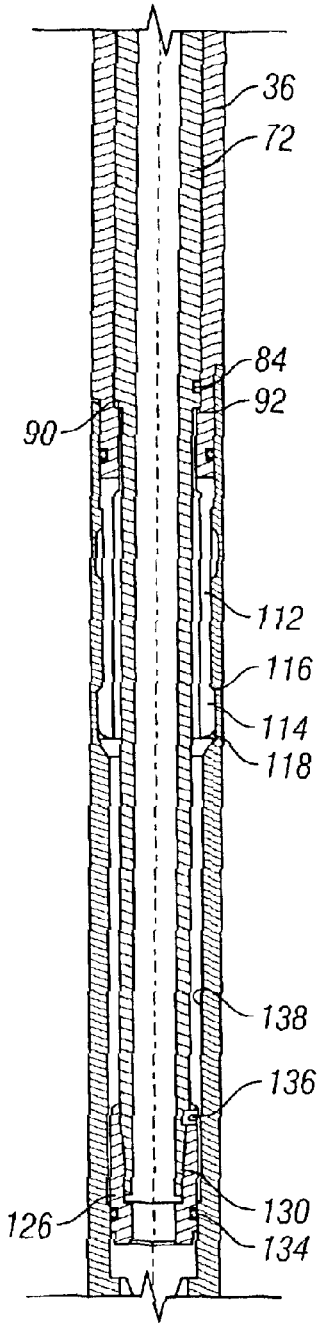

Referring to FIGS. 2B, 3B, and 4B, which are longitudinal sectional views each showing the lower portion of the disconnect check valve mechanism 28 and its releasable connection with the payload well servicing tool 30, it is desirable to provide a releasable coupling feature which permits the disconnect check valve mechanism to be simply and efficiently separated from the payload well servicing tool as desired. The payload housing 38 has an upper end 94 that receives a lower reduced diameter connection extension 96 of the upper housing section 36. An annular seal, such as an O-ring seal 98, maintains sealing of the upper housing section 36 and the payload housing 38. The internal pulling profile 104 of the payload housing 38 has an upper annular internal profile recess 106, a lower annular internal profile recess 108 and an intermediate annular profile recess 110. The lower reduced diameter connection extension 96 is machined or otherwise formed to define a plurality of elongate flexible collet fingers 112, each having lower ends defining locking dogs 114 that are received within the profile recesses of the internal pulling profile 104 when the collet fingers 112 are expanded.

The circular array of flexible collet fingers 112 collectively define a generally cylindrical connecting and releasing collet, with each of the flexible collet fingers 112 forced radially inwardly to the unlocking or releasing positions shown in FIG. 4B. In this position the locking dogs 114 are retracted from the upper and lower internal profile recesses 106, 108 and may engage the outer cylindrical surface of a tubular extension 124 of the inner tubular member 72. The locking dogs 114 each define tapered upper retention shoulders 116 and tapered lower guide shoulders 118 that react with internal tapered surfaces of the internal profile recesses for transmission of lateral or radial force to the collet fingers 112 if the locking dogs 114 of the collet fingers 112 do not completely retract from the profile recesses 106, 108 when collet unlocking occurs. The tapered upper retention shoulders 116 are of substantially matching configuration with internal tapered shoulders 120, 122 of the upper and lower annular internal profile recesses 106, 108 to thus establish a designed tension force for disconnect release and to permit initial upward movement of the collet relative to the internal pulling profile of the payload housing 38. When the collet has been unlocked from the internal pulling profile 104 and pulling tension is applied to the tubing string 43, the locking dogs 114 of the resilient collet fingers 112 will retract from the profile recesses. Thus, the tension force for disconnect separation is relatively minimal and is well within the tension force limits of coiled tubing. During this upward movement of the disconnect check valve mechanism, the seal of the annular sealing element 98 with the inner surface of the upper end 94 of the payload housing 38 will be broken and the inner tubular member or mandrel 72 will be retrieved from the well along with the disconnect check valve mechanism.

When the disconnect components are at the position shown in FIG. 2B, the circular collet finger array is locked with respect to the internal pulling profile 104 of the payload housing 38. The inner tubular member 72, is provided with a reduced diameter lower tubular extension 124 which is of sufficient length to bridge the disconnect mechanism with the inner tubular member 72 positioned at the check valve disabling position thereof as shown in FIGS. 2A and 2B. A collet locking cap 126 is secured by a threaded connection 128 to the lower externally threaded end 130 of the lower tubular extension 124. The collet locking cap 126, when positioned as shown in FIG. 2B, engages the inner surfaces of the locking dogs 114 of the flexible collet fingers 112, expands the collet, and secures the locking dogs 114 within the lower internal profile recess 108 and thus prevents inadvertent separation of the disconnect mechanism. When the collet locking cap 126 has been moved downwardly clear of the locking dogs 114, as shown in FIGS. 3B and 4B, the flexible collet fingers 112 can retract the locking dogs 114 from the lower internal profile recess 108. The collet locking cap 126 carries an external annular dynamic sealing element 134, which establishes sealing with an internal cylindrical surface 138 of the payload housing 38 and maintains such sealing during movement of the inner tubular member 72 between its valve disabling and enabling positions. To ensure that the collet locking cap 126 is maintained stationary with respect to the lower tubular extension 124, a set screw 136 or other suitable retainer is threaded through the locking cap and engages within a receptacle of the lower tubular extension. The lower tubular extension 124 of the inner tubular member 72, together with the collet locking cap 126, permits the lower portion of the inner tubular member 72 to maintain sealing with the internal surface 138 at all positions of the inner tubular member 72 within the payload housing 38. This sealing relation is broken only when the disconnect mechanism is separated and the upper housing section 36, with the inner tubular member or mandrel 72, are moved upwardly during retrieval from the well.

When disconnection of the check valve mechanism is not needed, the entire payload tool 30 and disconnect check valve mechanism 28 may be retrieved from the well as a unit, simply by applying tension force to the tubular housing 32 via the tubing string 43. The disconnect check valve of the present invention can be modified simply and efficiently to function as a tensile force actuated disconnect or a flow responsive or pressure responsive disconnect without departing from the scope of the present invention.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for conducting servicing operations in a well, comprising:

running into a well on a tubing string a disconnect check valve mechanism having a payload well servicing tool releasably connected thereto, said disconnect check valve mechanism including at least one check valve held in a disabled position permitting both direct and reverse circulating flow through said check valve mechanism;

conducting well servicing operations with said disconnect check valve mechanism and said payload well servicing tool;

actuating said disconnect check valve mechanism within the well to a check valve enabling position permitting only direct circulating flow through said check valve mechanism and to disconnect from said payload well servicing tool; and retrieving said disconnect check valve mechanism from the well, leaving said payload well servicing tool in the well.

2. The method of claim 1, wherein said payload well servicing tool defines a pulling profile, said method further comprising:

running a pulling tool into the well, engaging said pulling profile, and retrieving said payload well servicing tool from the well.

3. The method of claim 1, wherein said disconnect check valve mechanism has a housing and a check valve disabling mandrel is selectively movable within said housing from said check valve disabling position to said check valve enabling position, said method comprising:

running said disconnect check valve mechanism and said payload well servicing tool into the well and conducting well servicing operations with said check valve disabling mandrel retained within said housing at said check valve disabling position; and selectively releasing said check valve disabling mandrel from said housing and moving said chock valve disabling mandrel to said check valve enabling position.

4. The method of claim 1, wherein said disconnect check valve mechanism has a housing defining a first disconnect device and said payload well servicing tool defines a second disconnect device establishing releasable connection with said first disconnect device and a check valve disabling mandrel is movable within said housing from said check valve disabling position to said check valve enabling position, said method comprising:

running said disconnect check valve mechanism into the well with said payload well servicing tool connected thereto by releasable engagement of said first and second disconnect devices and with said check valve disabling mandrel positioned at said check valve disabling position and disabling said at least one check valve;

moving said check valve disabling mandrel from said check valve disabling position to said check valve enabling position;

releasing said releasable connection of said disconnect check valve mechanism with said payload well servicing tool; and applying tension force to said disconnect check valve mechanism via said tubing suing to retrieve said disconnect check valve mechanism from the well.

5. The method of claim 4, wherein said check valve disabling mandrel is an inner tubular member releasably secured within said housing at said check valve disabling position and is releasable from said housing for movement to said check valve enabling position, said method comprising:

when desired, releasing said inner tubular member from said housing and moving said inner tubular member from said check valve disabling position to said check valve enabling position to enable said at least one check valve.

6. The method of claim 4, wherein said check valve disabling mandrel defines a flow passage therethrough, said method comprising:

closing said flow passage of said check valve disabling mandrel thereby defining a pressure responsive mandrel area; and applying fluid pressure via said tubing string to said pressure responsive mandrel area and developing a pressure responsive releasing force on said check valve disabling mandrel for releasing said check valve disabling mandrel from said housing and moving said check valve disabling mandrel to said check valve enabling position.

7. The method of claim 6, wherein at least one housing component releasably retains said check valve disabling mandrel at said check valve disabling position within said housing, said method comprising:

said releasing said check valve disabling mandrel from said housing being applying predetermined pressure responsive force to said check valve disabling mandrel to release said at least one housing component and to move said check valve disabling mandrel to said check valve enabling position.

8. A disconnect check valve mechanism for wells, comprising:

a disconnect check valve housing having at least one check valve therein and having a first disconnect device; and a payload tool having a second disconnect device; wherein said first and second disconnect devices are releasably counted for running of said disconnect check valve housing and said payload tool and for conducting downhole operations, and are selectively releasable downhole to permit retrieval of said disconnect check valve housing with said check valve enabled for direct circulating flow only and with said payload tool remaining in the well wherein said first disconnect device is an annular collet having a plurality of flexible collet fingers each defining a locking dog; and said second disconnect device is an annular collet receptacle having a pulling profile defining a profile recess receiving said locking dogs; and further comprising a mandrel selectively positionable within said housing and having a check valve disabling element and a collet locking element, said mandrel being retained within said housing at a check valve disabling position with said check valve disabling element retaining said check valve open and with said collet locking element securing said locking dogs within said profile recess, said mandrel being selectively releasable from said housing and movable to a check valve enabling position with said check valve disabling element clear of said at least one check valve and with said collet locking element positioned to enable retraction of said locking dogs from said profile recess thereby permitting disconnect of said first and second disconnect devices and retrieval of said disconnect check valve housing.

9. A disconnect check valve mechanism for wells, comprising:

a disconnect check valve housing having at least one check valve therein and having a first disconnect device; and a payload tool having a second disconnect device; wherein said first and second disconnect devices are releasably coupled for running of said disconnect check valve housing and said payload tool and for conducting downhole operations, and are selectively releasable downhole to permit retrieval of said disconnect check valve housing with said check valve enabled for direct circulating flow only and with said payload tool remaining in the well further comprising said at least one check valve being dual check valves disposed in spaced-relation and each having a disabled valve position permitting both direct and reverse circulating flow and an enabled valve position preventing reverse circulating flow and permitting only direct circulating flow;

an inner tubular member defining a flow passage therethrough and being linearly movable relative to said disconnect check valve housing and having a check valve disabling position within said disconnect check valve housing maintaining said dual check valves at said disabled valve position and having a check valve enabling position within said disconnect check valve housing permitting flow responsive opening and closing of said dual check valves;

at least one retainer element releasably securing said inner tubular member in said check valve disabling position within said disconnect check valve housing and selectively releasing said inner tubular member for movement to said check valve enabling position; and a closure member positionable in flow passage closing engagement with said inner tubular member and defining with said inner tubular member a pressure responsive area, with said closure member in flow passage closing engagement with said inner tubular member fluid pressure of predetermined magnitude within said disconnect check valve housing developing a pressure induced force on said pressure responsive area for releasing said at least one retainer element and permitting pressure responsive movement of said inner tubular member to said check valve enabling position.

10. The disconnect check valve mechanism of claim 9, further comprising:

said disconnect check valve housing defining a pressure relief port; and an annular seal member carried by said inner tubular member and scaling said inner tubular member with respect to said disconnect check valve housing, upon predetermined downward movement of said inner tubular member within said disconnect check valve housing said annular seal member exposing at least a portion of said pressure relief port and relieving fluid pressure acting on said pressure responsive area.

11. A disconnect check valve mechanism for wells, comprising:

a disconnect check valve housing having at least one check valve therein and having a first disconnect device; and a payload tool having a second disconnect device; wherein said first and second disconnect devices are releasably coupled for running of said disconnect check valve housing and said payload tool and for conducting downhole operations, and are selectively releasable downhole to permit retrieval of said disconnect check valve housing with said check valve enabled for direct circulating flow only and with said payload tool remaining in the well, further comprising a tubing string connected to said disconnect check valve housing and extending to the surface of the well and being moved linearly upwardly or downwardly for movement of said disconnect check valve housing within the well and for application of tension force to said disconnect check valve housing and supplying fluid pressure to said disconnect check valve housing and conducting reverse circulating flow from said disconnect check valve housing;

said first and second disconnect devices having locked and released conditions of connection and when released being separable by lifting said disconnect check valve housing with said tubing string; and an inner tubular member linearly movable within said disconnect check valve housing between a first position disabling said at least one check valve and securing said first and second disconnect devices in locked connection and a second position enabling said at least one check valve and releasing said first and second disconnect devices from locked connection.

12. The disconnect check valve mechanism of claim 11 comprising:

said inner tubular member having a lower end located below said first and second disconnect devices and being in sealed relation with said payload tool at said first and second positions of said inner tubular member within said disconnect check valve housing, said lower end of said inner tubular member being withdrawn from said payload tool during retrieval of said disconnect check valve housing.

13. A disconnect check valve mechanism for positioning and retrieving a payload tool for a well, comprising:

a coiled tubing string extendable from the surface of the well to a desired depth within the well;

a disconnect check valve housing being connected to said coiled tubing string and having at least one check valve having a valve disabled position permitting both reverse circulating flow and direct circulating flow and an valve enabled position permitting only direct circulating flow;

a payload housing;

a disconnect mechanism releasably interconnecting said disconnect check valve housing and said payload housing and having a locked condition securing said disconnect check valve housing and said payload housing in assembly and an unlocked condition permitting separation of said disconnect check valve housing from said payload housing;

an inner tubular member defining a flow passage therethrough and being linearly movable within said disconnect check valve housing from a first position disabling said at least one check valve to a second position enabling said at least one check valve and permitting flow responsive opening and closing thereof; and at least one retainer element releasably securing said inner tubular member at said first position and releasing said inner tubular member for movement from said first position to said second position responsive to application of predetermined downward force on said inner tubular member.

14. The disconnect check valve mechanism of claim 13, further comprising:

a closure member selectively positionable in flow passage closing engagement with said inner tubular member and defining with said inner tubular member a piston area, fluid pressure of predetermined magnitude acting on said piston area developing a pressure induced force on said inner tubular member releasing said at least one retainer element and permitting pressure responsive movement of said inner tubular member to said second position.

15. The disconnect check valve mechanism of claim 13, wherein said disconnect mechanism comprises:

said payload housing defining a pulling profile having at least one profile recess; and a collet defined by said disconnect check valve housing and having a plurality of flexible collet fingers arranged in generally cylindrical array and each having a locking dog fitting within said profile recess, said flexible collet fingers being yieldable substantially radially for locking and unlocking movement relative to said profile recess.

16. The disconnect check valve mechanism of claim 15, comprising:

a check valve disabling element located on said inner tubular member and positioned within said disconnect check valve housing at said first position of said inner tubular member and maintaining said at least one check valve open, at said second position of said inner tubular member said check valve disabling element being positioned clear of said at least one check valve and permitting direct circulating flow; and a collet locking element located on said inner tubular member and at said first position of said inner tubular member maintaining said locking dogs of said flexible collet fingers within said profile recess for locking of said disconnect mechanism, and at said second position of said inner tubular member permitting retraction of said locking dogs of said flexible collet fingers from said profile recess for unlocking of said disconnect mechanism.

* * * * *